US008292066B2

(12) United States Patent
Lai

(10) Patent No.: US 8,292,066 B2
(45) Date of Patent: Oct. 23, 2012

(54) EMBROIDERY THREAD ORGANIZING CARD WITH CORRESPONDING THREAD AND EMBROIDERING INFORMATION

(75) Inventor: Ming Te Lai, Taipei County (TW)

(73) Assignee: Jean Card and Gift Co., Ltd., Sindian, Taipei County (TW)

( * ) Notice: Subject to any disclaimer, the term of this patent is extended or adjusted under 35 U.S.C. 154(b) by 0 days.

(21) Appl. No.: 13/188,310

(22) Filed: Jul. 21, 2011

(65) Prior Publication Data

US 2011/0272298 A1 Nov. 10, 2011

Related U.S. Application Data

(63) Continuation-in-part of application No. 12/627,277, filed on Nov. 30, 2009, now abandoned.

(30) Foreign Application Priority Data

Aug. 31, 2009 (CN) ..... 2009 2 0175880 U

(51) Int. Cl.
*B65D 85/00* (2006.01)
*D04B 3/06* (2006.01)

(52) U.S. Cl. ..... 206/49; 206/227; 206/388; 206/459.5; 223/107

(58) Field of Classification Search ..... 206/49, 206/227, 388, 459.5, 472–476, 495, 574, 206/805; 223/106, 107, 109 R
See application file for complete search history.

(56) References Cited

U.S. PATENT DOCUMENTS 1,343,934 A * 6/1920 Reynolds ..... 206/388
1,987,159 A 1/1935 Rasmussen
2,016,181 A * 10/1935 Sharp ..... 223/107
2,109,318 A * 2/1938 Lichter ..... 206/227
2,558,386 A * 6/1951 Rabinowitz ..... 223/107
2,646,196 A 7/1953 York
3,033,357 A 5/1962 Vogel
3,949,452 A 4/1976 Henderson
3,964,603 A 6/1976 Sandler
4,161,075 A 7/1979 Eubanks et al.
4,172,521 A 10/1979 Eubanks et al.
4,264,011 A 4/1981 Dalbo et al.
4,391,370 A 7/1983 Dalbo
4,664,302 A 5/1987 Dalbo et al.
5,385,237 A 1/1995 Mathews
5,775,504 A 7/1998 Menaged

* cited by examiner

*Primary Examiner* — Bryon Gehman
(74) *Attorney, Agent, or Firm* — Rabin & Berdo, P.C.

(57) ABSTRACT

An embroidery thread organizing card including a thread organizing structure having a front panel and a back panel, a barcode provided on a front side of the front panel near one corner thereof for material management, and instruction information provided on a rear side of the back panel showing things to be noted during embroidering, a plurality of information zones provided on the front side of the front panel, and a plurality of embroidery thread groups having a number and a location corresponding to that of the information zones and being clamped at an end to the thread organizing structure. Each of the information zones shows a thread color sample and information related to the use of the corresponding embroidery thread group. A user picking a thread for embroidery can at the same time obtain information related to the picked thread, so as to avoid using a wrong thread and to embroider efficiently.

6 Claims, 7 Drawing Sheets

EMBROIDERY THREAD ORGANIZING CARD WITH CORRESPONDING THREAD AND EMBROIDERING INFORMATION

RELATED APPLICATIONS

This application is a Continuation-In-Part application of U.S. Ser. No. 12/627,277 filed Nov. 30, 2009, which in turn claimed priority benefit of patent application in China 200920175880.0, filed Aug. 31, 2009, each incorporated herein by reference.

FIELD OF THE INVENTION

The present invention relates to an embroidery thread organizing card, and more particularly to an embroidery thread organizing card being provided with corresponding thread and embroidering information for sorting and organizing differently colored embroidery threads, allowing users to conveniently and correctly locate desired embroidery threads.

BACKGROUND OF THE INVENTION

With the popularization of DIY (do it yourself), many half-finished products serving as material for DIY are available in the gift market now. A user can purchase such half-finished products and use them to produce desired DIY gifts in an easy, convenient and quick manner. The user can also extend personal ideas in the DIY gifts to make them unique.

Among others, cross-stitch embroidery has been used in producing unique DIY crafts. Cross-stitch is a popular form of counted-thread embroidery in which x-shaped stitches are used to form a picture. Cross-stitch is usually executed on easily countable even-weave fabric. The embroiderer stitches in each direction so as to form the picture. Nowadays, needlecraft kits for cross-stitch are readily available in the market. It is no doubt the best choice for both a green hand and a skilled embroiderer of cross-stitch to purchase a needlecraft kit for producing a DIY cross-stitch work.

The needlecraft kits available in the market usually include embroidery threads, embroidery needles, a piece of Aida cloth, an instruction sheet, and a cross-stitch chart. These items are usually arbitrarily disposed in a clear polybag, a paper box, or a blister package while the embroidery threads are usually tied into bundles. A user has to sort and separate the embroidery threads of different colors from one another before using them.

To start the embroidery, the user first picks one strand of embroidery thread from multiple thread bundles for stitching, and then determines to which one of the embroidery threads indicated in the instruction sheet the picked thread corresponds. A large quantity of embroidery threads close in color is frequently used to complete a large-size embroidery design. However, the instruction sheet usually describes the thread colors by color names without color samples, and a user lacking sufficient experiences in embroidery has difficulty in determining correct embroidery thread colors simply from the described color names. There are times the user uses embroidery threads of wrong colors to stitch and must take time to remove the wrong threads from the Aida cloth later. Sometimes, the use of wrong embroidery threads would also result in shortage of the embroidery threads.

After picking the embroidery thread according to the instruction sheet, the user needs to check the instruction sheet for the type of stitch and the number of strands with which the picked embroidery thread is to be used for embroidering, and then checks the cross-stitch chart for index marks the same as those shown in the instruction sheet to know the positions on the Aida cloth at where the picked embroidery thread is to be used for stitching. That is, in the currently available needlecraft kits, all information related to the embroidery, such as the thread color, the stitches to be used, the index marks shown on the cross-stitch chart, the number of strands of threads to be used, or the special skill of combining different embroidery threads, is printed on the instruction sheet. In the process of embroidery, the user has to repeat the procedures of picking a thread from the bundles, checking the instruction sheet for correct stitch, number of strands and index marks for the picked thread, and finding corresponding index marks on the cross-stitch chart to ensure the positions to be stitched with the picked thread. Errors tend to occur while the user repeatedly deals with these complicated procedures.

Moreover, the use of incorrect embroidery threads would usually result in shortage of the wrongly used embroidery threads. Since the embroidery threads packed in the currently available needlecraft kits are not identified with part numbers while there are many threads close in color, the user is prevented from conveniently and correctly ordering or purchasing additional lengths from the supplier to make up the insufficient embroidery threads. It is therefore desirable to improve the manner of supplying and packaging embroidery threads in the existing needlecraft kits for cross stitch, in order to eliminate consumers' confusion in using the embroidery threads and advantageously expand the suppliers' business in the market.

SUMMARY OF THE INVENTION

A primary object of the present invention is to provide an embroidery thread organizing card, on which a plurality of information zones showing information about thread color codes, embroidering stitches, and number of strands of threads needed in embroidering is provided, and a plurality of embroidery thread groups is sorted and orderly held to the card corresponding to the information zones, so that a user can pick correct threads for embroidery according to the information provided on the card without the risk of using wrong threads due to insufficient experience in embroidery. Meanwhile, with the embroidery thread organizing card, when a user picks an embroidery thread for use, the user can simultaneously know the embroidery stitch to be used and the symbol on the cross-stitch chart corresponding to the picked embroidery thread. Therefore, the time and procedures needed to sort and organize the embroidery threads can be reduced, and the embroidery can be completed more efficiently without mistakes.

To achieve the above and other objects, the embroidery thread organizing card with corresponding thread and embroidering information according to a preferred embodiment of the present invention includes a thread organizing structure having a front panel and a back panel glued to a rear side of the front panel; a plurality of embroidery thread groups being held to a lower edge of the thread organizing structure and spaced from one another by a first distance, each of the embroidery thread groups including at least one embroidery thread bundle, and the embroidery thread bundle each having an end glued to between the front panel and the back panel; and a plurality of information zones being provided on a front side of the front panel of the thread organizing structure and in number corresponding to that of the embroidery thread groups, so that each of the information zones corresponds to one of the embroidery thread groups, and a color sample and embroidery-related information being shown in each of the information zones corresponding to the embroidery thread group thereof.

According to another preferred embodiment of the present invention, the embroidery thread groups are clamped to between the front panel and the back panel; and each of the embroidery thread groups includes a plurality of embroidery thread bundles, and the embroidery thread bundles in each of the embroidery thread groups are spaced from one another by a second distance, which is smaller than the first distance. Further, each of the embroidery thread bundles is formed by twisting multiple strands of embroidery threads together.

In another embodiment of the present invention, the front panel is provided on the front side thereof with a barcode for the purpose of material management; and in each of the information zones, there are shown at least one index mark, a stitching mark corresponding to the index mark and including a stitch symbol and a strand mark, and a material mark. According to an embodiment, the front panel and the back panel are respectively made of a cardboard.

In another preferred embodiment, the back panel includes a foam-rubber layer bonded to the rear side of the front panel and a cardboard layer bonded to a rear side of the foam-rubber layer, and the back panel is provided on a rear side of the cardboard layer with instruction information showing things to be noted during embroidering. The instruction information can include any combinations of texts, numerals and pictures.

In a still further embodiment, each of the information zones is provided at a predetermined position with a thread-holding hole.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
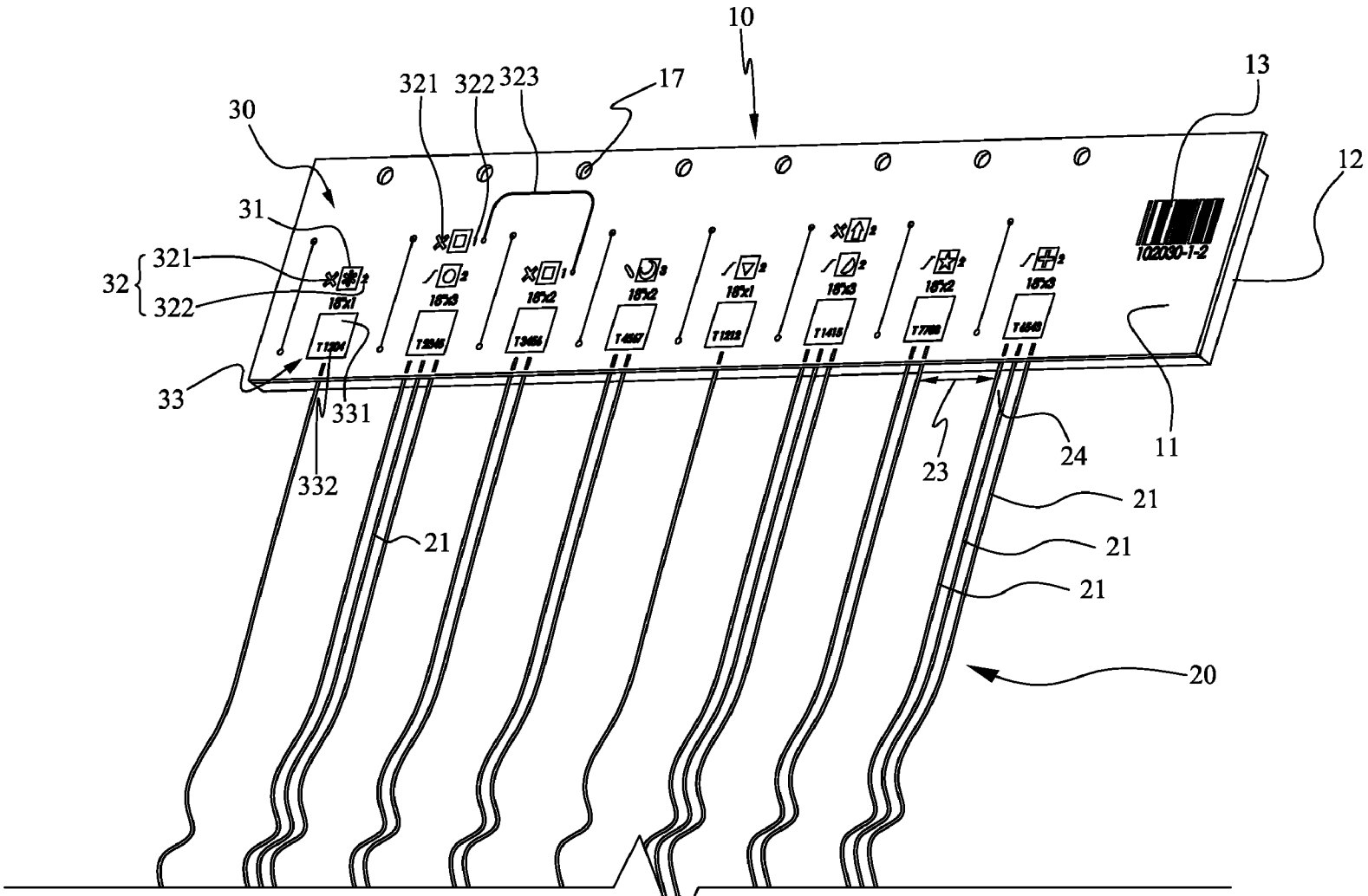
FIG. 1 is an assembled front perspective view of an embroidery thread organizing card with corresponding thread and embroidering information according to a preferred embodiment of the present invention.
Figure 2:
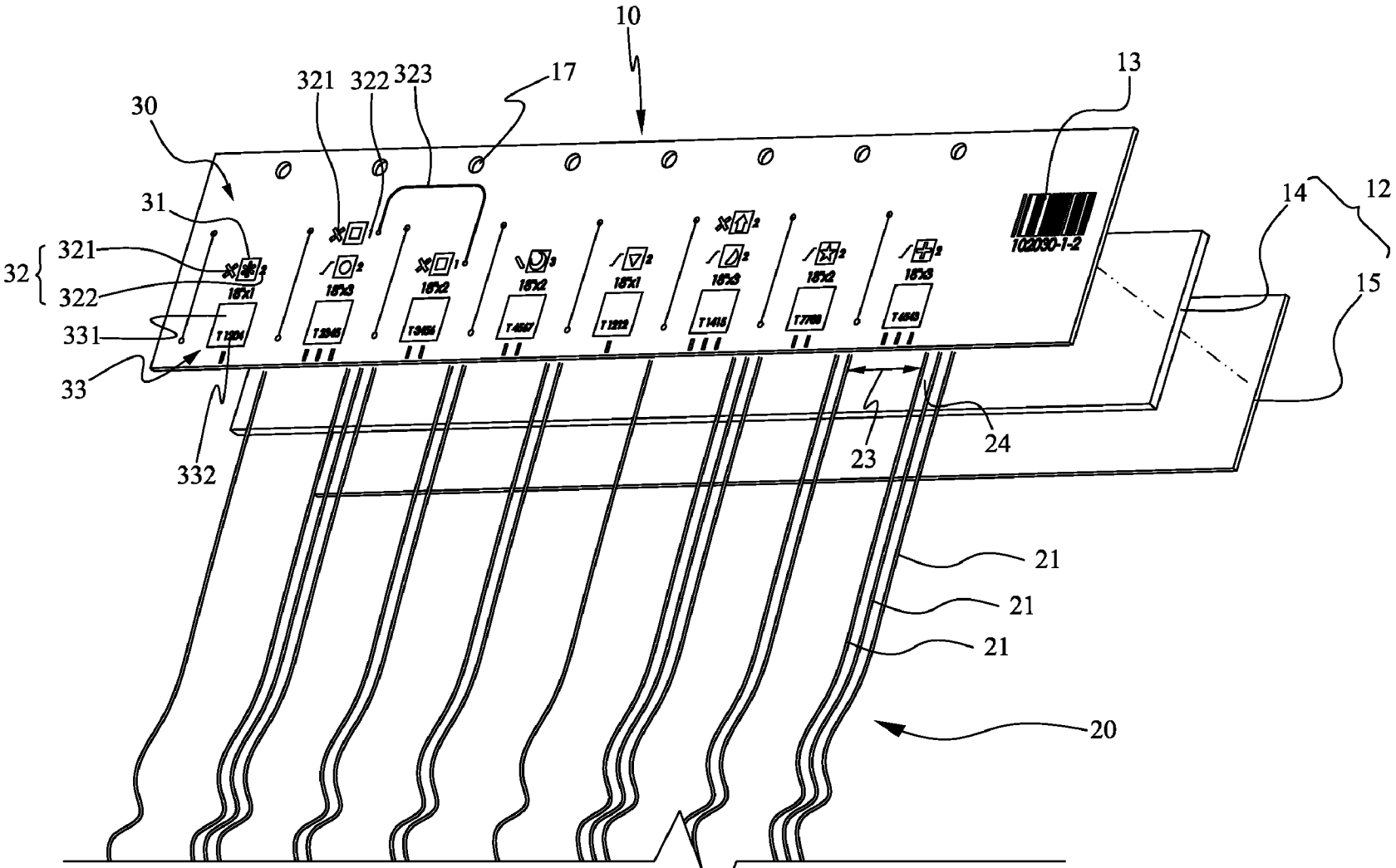
FIG. 2 is an exploded view of FIG. 1.

Please refer to FIGS. 1 and 2 that are assembled and exploded front perspective views, respectively, of an embroidery thread organizing card according to a preferred embodiment of the present invention. As shown, in the preferred embodiment, the embroidery thread organizing card includes a thread organizing structure 10, a plurality of embroidery thread groups 20 held to the thread organizing structure 10, and a plurality of information zones 30 provided on a surface of the thread organizing structure 10.

The thread organizing structure 10 includes a front panel 11 and a back panel 12 attached to a rear side of the front panel 11. In the illustrated preferred embodiment, the front panel 11 and the back panel 12 are glued to each other, and are respectively made of a cardboard 15. Each of the embroidery thread groups 20 includes at least one embroidery thread bundle 21, and the embroidery thread bundles 21 in the same one embroidery thread group 20 are the same in color. The embroidery thread bundles 21 in the embroidery thread groups 20 respectively have an end clamped and glued to between the front panel 11 and the back panel 12 near a lower edge of the thread organizing structure 10, and any two adjacent embroidery thread groups 20 are spaced from one another by a first distance 23 to prevent the embroidery thread bundles 21 in different embroidery thread groups 20 from tangling with one another.

The information zones 30 are provided on a front side of the front panel 11 at positions and in number corresponding to those of the embroidery thread groups 20. In each of the information zones 30, there are shown a color sample of embroidery threads 22, which are twisted together to form the embroidery thread bundles 21 in each embroidery thread group 20; and information related to the use of the embroidery threads 22 to embroider. In the case two or more embroidery thread bundles 21 are included in one embroidery thread group 20, any two adjacent ones of the embroidery thread bundles 21 in that embroidery thread group 20 are spaced by a second distance 24 to prevent them from tangling with one another. Meanwhile, the second distance 24 is smaller than the first distance 23, lest a user should confuse the embroidery thread bundles 21 in one embroidery thread group 20 with those in other adjacent embroidery thread groups 20. Further, with the above arrangements, the user can more easily count the embroidery thread bundles 21 in each embroidery thread group 20.

Figure 3:
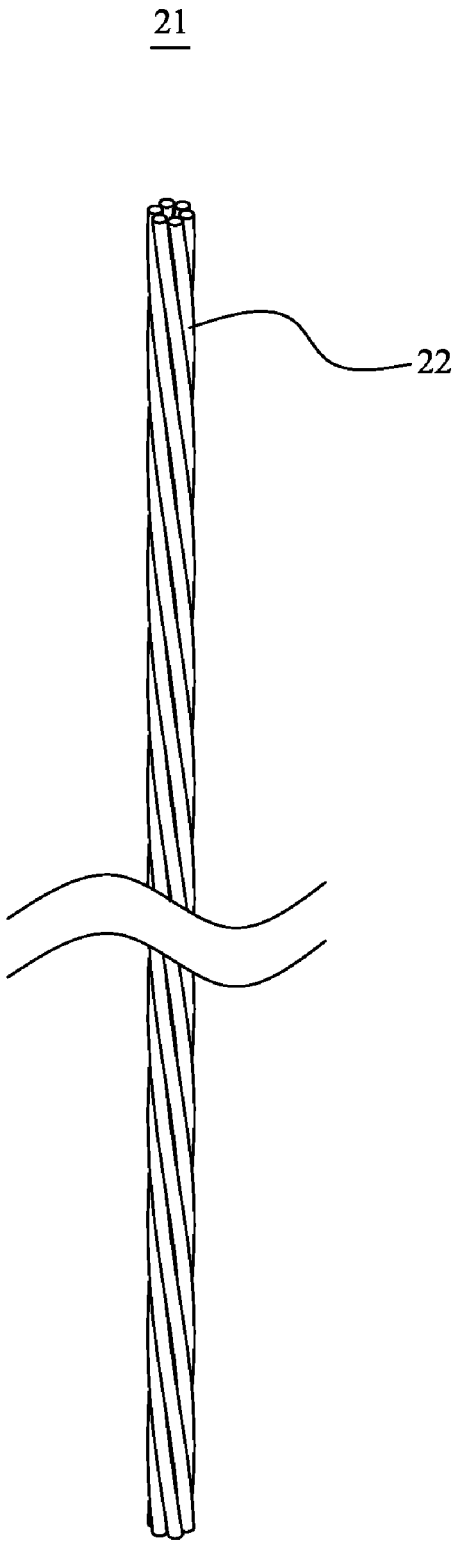
FIG. 3 is a perspective view of an embroidery thread bundle according to the present invention, being formed by twisting together predetermined strands of embroidery threads.

Please refer to FIG. 3. According to the illustrated preferred embodiment, each of the embroidery thread bundles 21 includes six strands of embroidery threads 22 that are twisted in the same direction into a bundle, so that the user can easily pick and separate predetermined strands of embroidery threads 22 from one embroidery thread bundle 21 for use. By twisting predetermined strands of embroidery threads 22 into individual embroidery thread bundles 21, and spacing embroidery thread bundles 21 of different thread colors from one another to form a plurality of spaced embroidery thread groups 20, the user may easily count the available quantity of embroidery threads 22 and pick desired embroidery threads 22 for use.

Figure 4:
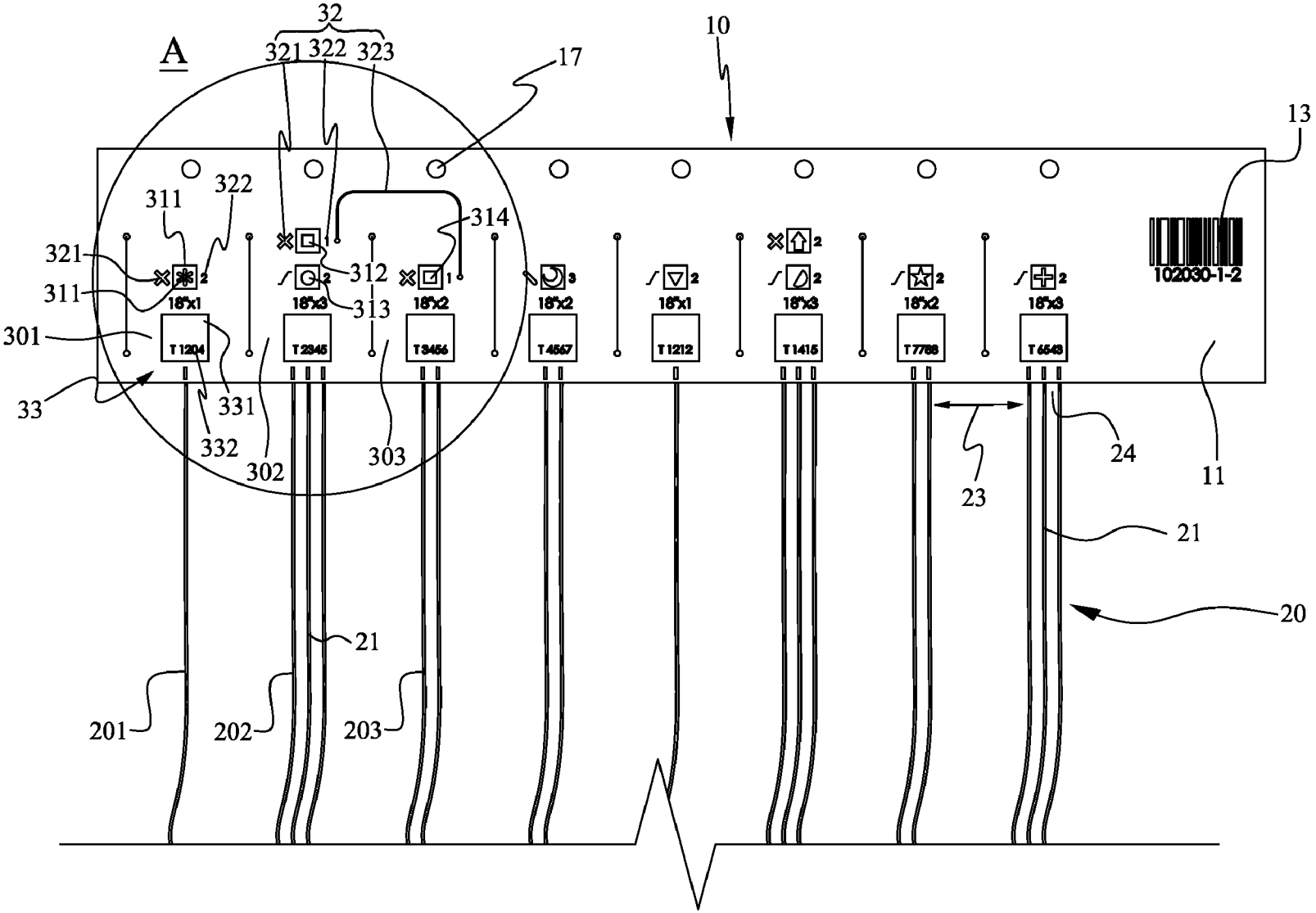
FIG. 4 is a front view of FIG. 1.

FIG. 4 is a front view of the embroidery thread organizing card of the present invention. As shown, a barcode 13 is provided on the front side of the front panel 11 near one corner thereof for material management in producing the embroidery thread organizing card. And, in each of the information zones 30, there are shown at least an index mark 31, a stitching mark 32, and a material mark 33. Two or more different index marks 31 may be shown in one information zone 30, and each of the index marks 31 is shown corresponding to one stitching mark 32. However, there is always one single material mark 33 shown in each information zone 30.

In the illustrated preferred embodiment, the stitching mark 32 shown in each of the information zones 30 includes at least one stitch symbol 321 indicating the stitch to be used with the embroidery threads 22 corresponding to the information zone 30 and a strand mark 322 indicating the number of strands of the embroidery threads 22 to be used for stitching. The material mark 33 includes at least a color sample 331 and a thread part number 332 for the embroidery threads 22 corresponding to the information zone 30.

Figure 5:
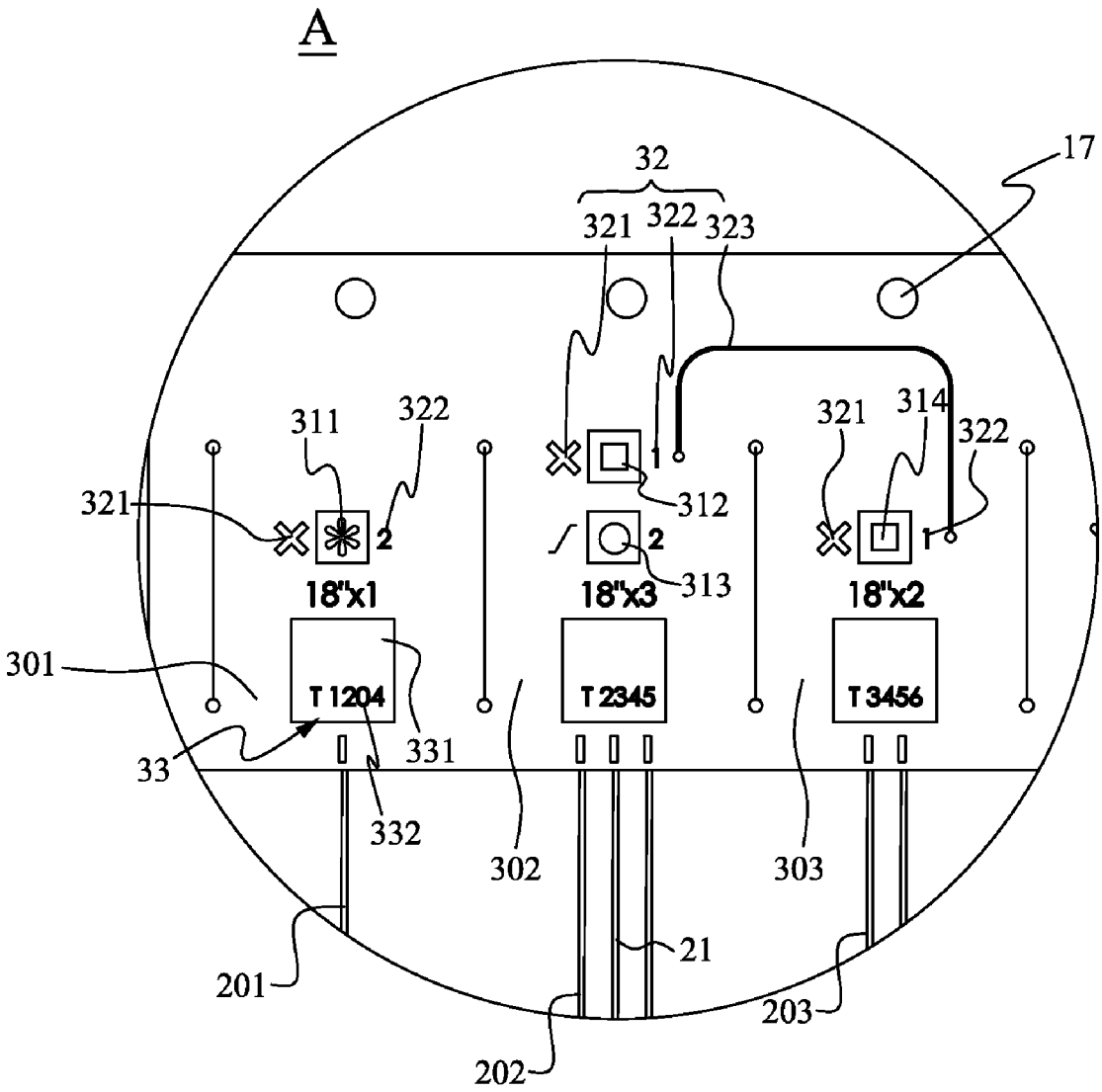
FIG. 5 is an enlarged view of the circled area A of FIG. 4.

FIG. 5 is an enlarged view of the circled area "A" in FIG. 4. Please refer to FIGS. 4 and 5 at the same time. To facilitate easy explanation of the present invention below, the first three information zones 30 shown on the left side of the front panel 11 are sequentially referred to as first, second and third information zones 301, 302, 303 herein; and the embroidery thread groups 20 corresponding to these information zones 301, 302, 303 are sequentially referred to as first, second and third embroidery thread groups 201, 202, 203.

As can be seen from FIGS. 4 and 5, in the first information zone 301, there are shown one single first index mark 311, one stitching mark 32 located corresponding to the first index mark 311, and one material mark 33. In the illustrated preferred embodiment, the first index mark 311 is an asterisk (*), which is similarly shown on a cross-stitch chart (not shown) for indicating the locations on an Aida cloth at where the embroidery threads 22 in the first embroidery thread group 201 should be used to stitch. The stitching mark 32 in the first information zone 301 includes a stitch symbol 321 indicating the type of stitch to be used with the embroidery threads 22 in the first embroidery thread group 201, and a strand mark 322 indicating the number of strands of the embroidery threads 22 to be used for stitching. In the illustrated preferred embodiment, the stitch symbol 321 is "x" to represent cross stitch, and the strand mark 322 is an Arabic numeral "2" to indicate two strands of embroidery threads 22 are to be used for stitching. For a user to locate the first index mark 311 easily, the stitch symbol 321 and the strand mark 322 are separately shown at two lateral sides of the first index mark 311, and are smaller in size compared to the first index mark 311. However, it is understood the above description of different marks in the information zone 30 are only illustrative and not intended to limit the marks to any specific designs and locations in any way.

The material mark 33 in the first information zone 301 includes at least one color sample 331 and one thread part number 332. In the case additional lengths of a certain embroidery thread 22 must be purchased, the user can directly compare the needed embroidery thread 22 with the color samples 331 to ascertain the part number 332 of the embroidery thread 22 before ordering or purchasing same. With the color sample 331 and the part number 332 included in one material mark 33, a user may very easily determine the type of insufficient embroidery thread 22 and order the same from the supplier.

In the second information zone 302, there are shown a second index mark 312 and a third index mark 313. While the embroidery threads 22 in the second embroidery thread group 202 corresponding to the second information zone 302 are same in color, they can be used at different positions in the cross-stitch chart with different strands or different stitches. Therefore, different index marks, such as the second and the third index mark 312, 313, are shown in the second information zone 302 to indicate different positions on the chart at where the embroidery threads 22 in the second embroidery thread group 202 are used to stitch. In the illustrated preferred embodiment, the second index mark 312 is a square. Further, the stitching mark 32 in the second information zone 302 includes not only a stitch symbol 321 indicating cross stitch and a strand mark 322 of an Arabic numeral "1" indicating one strand of embroidery thread to be used for stitching, which are shown at two lateral sides of the square, but also a linking line 323 extending from the right side of the strand mark 322 to the third information zone 303.

In the third information zone 303, there are shown a fourth index mark 314, which is a square the same as that indicated by the second index mark 312, a strand mark 322 located at the right side of the square of the fourth index mark 314 to indicate one strand of embroidery thread 22 in the third embroidery thread group 203 is to be used for stitching, and the linking line 323 extended from the second information zone 302 to the third information zone 303. The linking line 323 indicates the positions in the chart showing the second index mark 312 should be stitched using one strand of the thread 22 in the second embroidery thread group 202 and one strand of the thread 22 in the third embroidery thread group 203, which are twisted together before being used to make cross stitches.

By arranging the index mark 31, stitching mark 32 and material mark 33 in each of the information zones 30 in the above-described manner, a user using the embroidery thread organizing card of the present invention can very conveniently estimate the quantities of different types of embroidery threads 22 and pick the required embroidery threads 22 for stitching. The user can also quickly identify the required stitches, number of strands or even the embroidery threads for combining colors while picking the embroidery threads 22, so that the embroidery can be completed in high efficiency.

Figure 6:
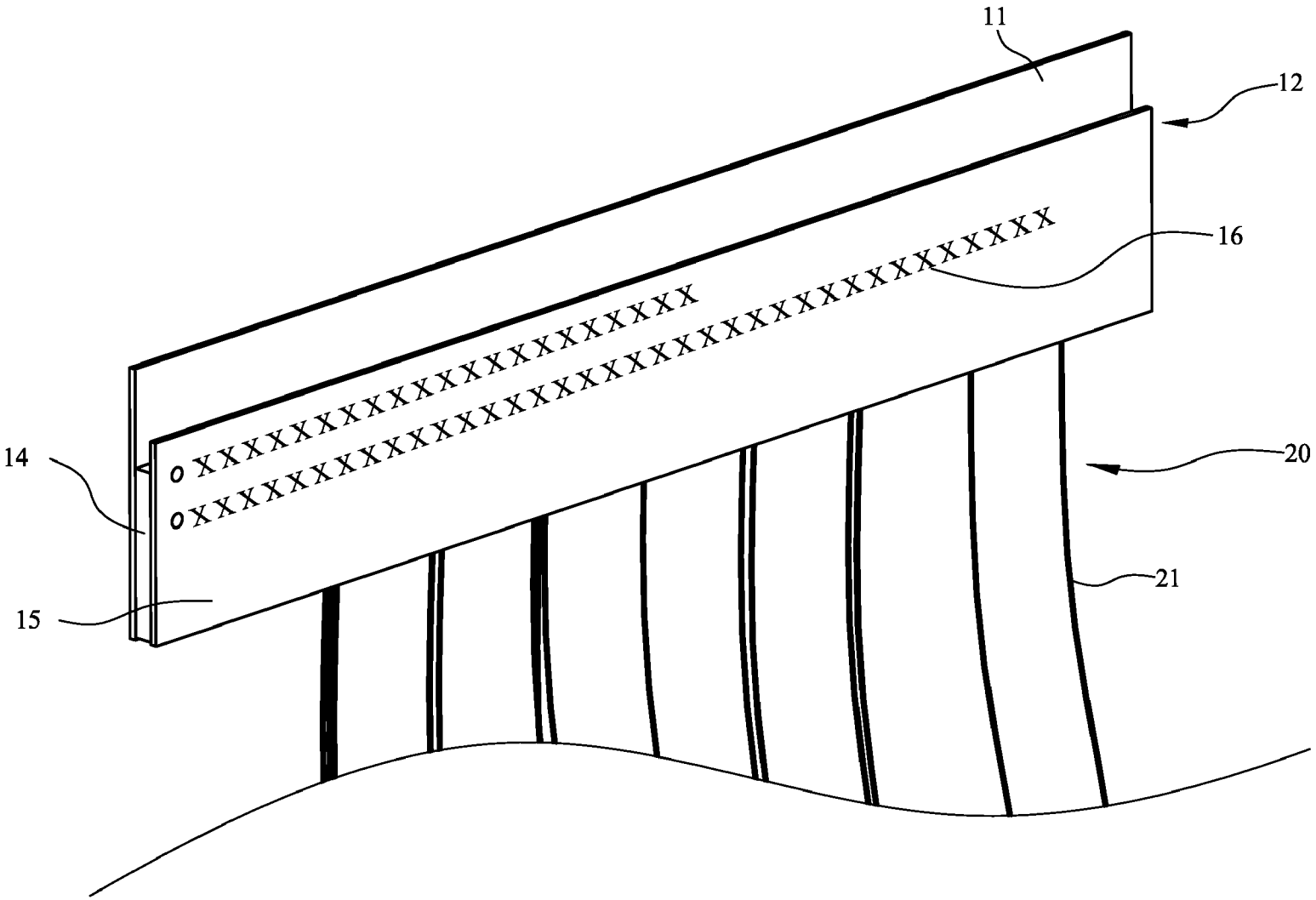
FIG. 6 is an assembled rear perspective view of the embroidery thread organizing card of the present invention.

FIG. 6 is a rear view of the embroidery thread organizing card of the present invention. Please refer to FIGS. 2 and 6 at the same time. In the illustrated preferred embodiment, the embroidery thread groups 20 are clamped to between the front panel 11 and the back panel 12. And, a foam-rubber layer 14 is further glued to between the front panel 11 and the cardboard 15 of the back panel 12 to give the back panel 12 increased thickness and structural strength. The back panel 12 is further provided on a rear side thereof with instruction information 16 showing things to be noted during embroidering. The instruction information 16 may include any combinations of texts, numerals and pictures.

Figure 7:
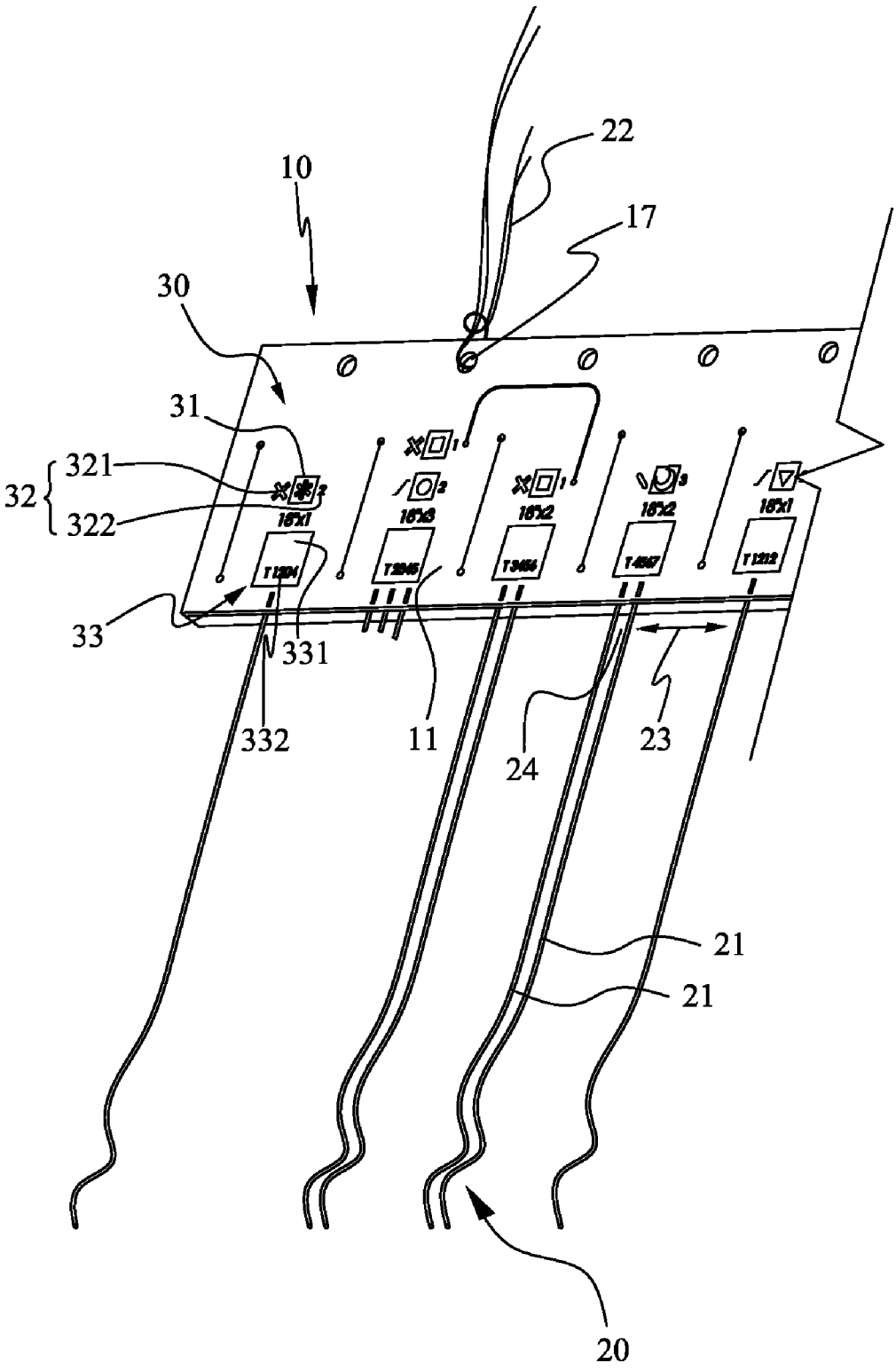
FIG. 7 shows the use of the embroidery thread organizing card of the present invention to hold remaining or supplemental threads.

Please refer to FIGS. 1 and 7 at the same time. Each of the information zones 30 is provided at a predetermined position with a thread-holding hole 17. Remaining segments of embroidery threads 22 that have been cut from the embroidery thread organizing card for stitching or additionally purchased supplemental embroidery threads 22 can be extended through corresponding thread-holding holes 17 and kept in an orderly manner to avoid unnecessary waste of unused embroidery threads 22.

When a user picks any desired embroidery thread 22 from one information zone 30 of the embroidery thread organizing card, the index mark 31 helps the user to quickly find the positions in the chart at where the picked thread 22 is to be used for stitching, and the stitching mark 32 helps the user to determine the type of stitch and the strands of thread to be used for embroidering. The linking line 323 extending between two or more different information zones 30 also helps the user to clearly identify the embroidery threads 22 that should be used together for showing combined colors during embroidery. Since all information needed to complete a desired embroidery design, such as the required strands of embroidery threads 22, the types of stitches to be used and the like, can be simultaneously obtained from the organizing card when the user picks the embroidery threads 22, the user can easily complete the embroidery simply by checking the corresponding cross-stitch chart for the positions at where the picked embroidery threads 22 should be used for stitching.

In the case additional lengths of some embroidery threads 22 must be purchased during the process of embroidering, the user may also conveniently compare the needed threads 22 with the color samples 331 shown in the information zones 30 to identity the correct part numbers 332 of the needed embroidery threads 22 and uses the identified part numbers 332 to order or purchase supplemental embroidery threads 22 from the supplier.

In brief, with the embroidery thread organizing card of the present invention formed of a thread organizing structure, a plurality of information zones and a plurality of embroidery thread groups, embroidery threads can be sorted, organized and stored on the thread organizing structure according to their colors to minimize the chance of using wrong embroidery threads. Meanwhile, since a user can obtain all necessary information about using the embroidery threads while picking the same for use, the embroidery work, such as a cross-stitch embroidery work, can be more easily completed.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An embroidery thread organizing card with corresponding thread and embroidering information, comprising:

a thread organizing structure having a front panel and a back panel glued to a rear side of the front panel, the back panel including a foam-rubber layer bonded to the rear side of the front panel and a cardboard layer bonded to a rear side of the foam-rubber layer;

a plurality of embroidery thread groups held to a lower edge of the thread organizing structure and clamped between the front panel and the back panel, two adjacent ones of the plurality of embroidery thread groups being apart from each other by a first distance, each of the embroidery thread groups including a plurality of embroidery thread bundles, two adjacent ones of which are apart from each other by a second distance smaller than the first distance, each embroidery thread bundle being formed by twisting multiple strands of embroidery threads together and having an end thereof glued between the front panel and the back panel; and a plurality of information zones provided on a front side of the front panel of the thread organizing structure and in a number corresponding to that of the embroidery thread groups, so that each of the information zones corresponds to one of the embroidery thread groups, a color sample and embroidery-related information being shown in each of the information zones corresponding to the embroidery thread group thereof.

2. The embroidery thread organizing card as claimed in claim 1, wherein the front panel has on the front side thereof a barcode for material management.

3. The embroidery thread organizing card as claimed in claim 1, wherein the front panel is made of a cardboard.

4. The embroidery thread organizing card as claimed in dam 1, wherein the back panel has on a rear side thereof an instruction information zone.

5. The embroidery thread organizing card as claimed in dam 1, wherein each of the information zones has at a predetermined position a thread-holding hole.

6. The embroidery thread organizing card as claimed in claim 1, where the embroidery-related information includes a stitching mark and a material mark.

* * * * *